US008763547B2

(12) United States Patent
Costas et al.

(10) Patent No.: US 8,763,547 B2
(45) Date of Patent: Jul. 1, 2014

(54) APPARATUS FOR LOWERING DRAG ON A MOVING NAUTICAL VESSEL

(71) Applicants: Dan Nicolaus Costas, Apollo Beach, FL (US); Alexander Nicholas Costas, Apollo Beach, FL (US)

(72) Inventors: Dan Nicolaus Costas, Apollo Beach, FL (US); Alexander Nicholas Costas, Apollo Beach, FL (US)

( * ) Notice: Subject to any disclaimer, the term of this patent is extended or adjusted under 35 U.S.C. 154(b) by 0 days.

(21) Appl. No.: 13/791,454

(22) Filed: Mar. 8, 2013

(65) Prior Publication Data

US 2014/0030118 A1 Jan. 30, 2014

Related U.S. Application Data

(60) Provisional application No. 61/741,595, filed on Jul. 25, 2012.

(51) Int. Cl.
*B63B 1/34* (2006.01)

(52) U.S. Cl.
USPC ..... 114/67 A

(58) Field of Classification Search
CPC ..... B63B 1/38; B63B 2001/387
USPC ..... 440/38
See application file for complete search history.

(56) References Cited

U.S. PATENT DOCUMENTS 661,303 A 11/1900 Briggs
907,086 A 12/1908 Naselius
1,697,257 A 1/1929 Anissimoff
1,747,817 A * 2/1930 Choquette ..... 440/47
1,822,223 A 8/1931 Klinger
1,894,256 A 1/1933 de Ganahl et al.
2,145,463 A 1/1939 Spinanger
2,378,822 A 6/1945 Barry
2,954,750 A 11/1954 Crump et al.
2,764,954 A * 10/1956 Oeltgen ..... 440/40
3,342,032 A 9/1967 Cox et al.
3,534,699 A 10/1970 Ruona
4,393,802 A 7/1983 Rizzo
4,513,679 A 4/1985 Allen
5,031,559 A 7/1991 Bartholomew
5,054,412 A 10/1991 Reed et al.
5,090,352 A 2/1992 Stanford (Continued)

FOREIGN PATENT DOCUMENTS

EP 000645302 A1 3/1995
JP 361220997 A 10/1986

(Continued)

OTHER PUBLICATIONS

Nouri, N. M. et al., "Improvement of a Microbubble Generator's Performance via Reliance on Fluid Dynamics Characteristics", Journal, Jun. 2009, pp. 189-194, vol. 25-2, Journal of Mechanics, Tehran, Iran.

(Continued)

*Primary Examiner* — Edwin Swinehart

(57) ABSTRACT

This present invention is a method and apparatus for drag reduction for a nautical vessel. The nautical vessel produces air bubbles and interposes the air bubbles between the exterior of the hull of a nautical vessel and the body of water that the vessel is moving through. Rather than utilizing an air compressor or other external energy source, the compressed air is generated from the movement of the vessel and is released where needed in order to reduce drag on the vessel.

8 Claims, 2 Drawing Sheets

(56) References Cited

U.S. PATENT DOCUMENTS

| | | | |
|---|---|---|---|
| 5,117,882 | A | 6/1992 | Stanford |
| 5,456,201 | A | 10/1995 | Bobst |
| 5,476,056 | A | 12/1995 | Tokunaga et al. |
| 5,524,568 | A | 6/1996 | Bobst |
| 5,575,232 | A | 11/1996 | Kato et al. |
| 5,613,456 | A | 3/1997 | Kuklinski |
| 5,967,071 | A | 10/1999 | Wipper |
| 6,092,480 | A | 7/2000 | Takahashi et al. |
| 6,145,459 | A | 11/2000 | Takahashi et al. |
| 6,186,085 | B1 | 2/2001 | Kato et al. |
| 6,324,480 | B1 | 11/2001 | Takahashi et al. |
| 6,356,816 | B1 | 3/2002 | Katz |
| 6,748,891 | B2 | 6/2004 | Takahashi |
| 6,789,491 | B2 | 9/2004 | Takahashi et al. |
| 7,004,094 | B2 | 2/2006 | Carson |
| 7,017,505 | B2 | 3/2006 | Burg |
| 7,267,067 | B2 | 9/2007 | Stubblefield et al. |
| 7,997,221 | B2 | 8/2011 | Costas |
| 8,327,784 | B2 | 12/2012 | Costas et al. |

FOREIGN PATENT DOCUMENTS

| | | | |
|---|---|---|---|
| JP | 03243489 | A | 10/1991 |
| JP | 2001239995 | A | 9/2001 |
| JP | 02002274478 | A | 9/2002 |

OTHER PUBLICATIONS

Seminar Topics, "Drag Reduction in Ships using Microbubbles Technology", Report, Feb. 2010, Published online at www.seminarprojects.com.

* cited by examiner

APPARATUS FOR LOWERING DRAG ON A MOVING NAUTICAL VESSEL

CROSS-REFERENCE TO RELATED APPLICATIONS

This application takes priority from U.S. Provisional Patent Application No. 61/741,595, filed on Jul. 25, 2012, titled "Bubble Generator for Lowering Drag on a Moving Vessel," by inventors Dan Nicolaus Costas and Alexander Nicholas Costas, the contents of which are expressly incorporated herein by this reference.

FIELD OF INVENTION

This invention generally relates to a method and apparatus for drag reduction for a nautical vessel. In particular, the present invention relates to a method and apparatus of drag reduction for a nautical vessel by interposing air bubbles between the exterior of the hull of a nautical vessel and the body of water that the vessel is moving through. Preferably, compressed air is generated from the movement of the vessel and is released where needed in order to reduce drag on the vessel.

BACKGROUND

For years, nautical vessel makers have been aware that placing air bubbles on the bottom of a vessel hull will reduce drag of the vessel as the vessel passes through water. Nautical vessel makers have addressed this issue by placing air bubbles on the bottom of the hull, using high energy air compressors. This is typically accomplished by mounting screens and/or ejector slits on the exterior hull surface of a ship, predominantly on the bottom side.

Unfortunately, due to the large surfaces of the hull that need to be covered, large amounts of air is required at the bottom of the ship. Screens or ejector slits also need to be cleaned constantly to prevent the clogging generated due to the accumulation of algae, barnacles and other marine organisms. Hull bottoms with air cavities expose only a fraction of the bottom of the hull to direct contact with the water, thus reducing the drag by the same fraction.

The concept of using air coated hulls to reduce drag in water has previously been suggested in the maritime literature. Indeed, reducing the hull skin friction component of drag by injecting bubbles or micro-bubbles was first reported in 1973 by the United States Naval Academy using a cylinder coated with small bubbles of hydrogen generated by electrolysis to study reduction in friction. More recently, the United States Defense Advanced Research Projects Agency (DARPA) funded a program to research reduction in friction drag focusing on developing numerical models, scale model experiments, and computer simulations for air/bubble injection. In Japan, the National Maritime Research Institute (NMRI) and the Shipbuilding Research Association has carried out bubble experiments using ships and scale models of ships in addition to plate experiments in test tanks. It has been reported that effects occur, including: (1) the reduced viscosity of air; and (2) the shearing of bubbles in the boundary layer. Hull skin friction reductions of up to 5% were reported for ships and up to 80% drag reduction for flat plates. In these experiments, the bubbles were active injections and had a power penalty. Moreover, they were only effective near the point of injection because they did not remain within the boundary layer close to the hull. In the NMRI full-scale tests they also degraded the efficiency of propellers. Another approach pioneered in Russia has been to pump air behind wedge and stepped shaped features to create an air-film along the body of the object, for example a torpedo, or via supercavitation to create the same effect.

It is clear that air films retained at a submerged solid surface should be able to reduce drag, but current approaches require an active input of energy to do so. For example, U.S. Pat. No. 5,524,568, issued to Bobst, discloses a boat hull that "creates a layer or film of bubbles adjacent to the submerged region of a boat hull by releasing a flow of air at numerous spaced apart locations on that region of the hull." However, the Bobst invention requires the use of an air compressor pump, which takes energy and greatly reduces or even completely offsets the energy savings achieved by the effect of the bubbles.

There are several patents issued in this field using air bubbles which have been proved in lab tests to lower up to 80% the frictional component of the drag generated by a vessel's motion through water. Due to the fact that the air bubbles are most effective if they are released in a manner such that they will wash (or lubricate) the flat hull's bottom, and not released in a manner such that the air bubbles go out and up the side of the hull, the vast majority of these patents explicitly teach or suggest the use of an air compressor. An air compressor is the obvious way to overcome the high static water pressures present at the bottom of the submerged vessel hull. Unfortunately, standard air compressors, while able to deliver air at high pressure, are very inefficient at delivering the high volumes of air needed for covering the large bottom surfaces of a flat bottomed vessel. Moreover, the energy economy obtained by the lubrication is largely offset by the air compressor's fuel consumption, rendering this solution essentially useless.

Other references, such as U.S. Pat. No. 6,748,891, try to replace the compressor using the various methods to create depression where air is drawn, and combine these methods with a standard air fan. The problem with U.S. Pat. No. 6,748,891 and other similar references is that the small pressure differentials created work only for relatively small drafts. Additionally, regarding the combination with an air fan, there is a tradeoff between the volume and the pressure of the air delivered, making them undesirable in applications where both high volume and high pressure are needed. Simply put, the solutions offered by these references do not work beyond a certain draft, and are essentially worthless. Finally, the above suggested solutions are invasive to the hull and expensive to implement on either an existing hull or a newly built hull. The solutions also create additional drag by adding wings outside the originally designed frame of the boat.

Furthermore, other prior art references disclose an air injector, which is disposed in the stream of water going downwards and under the hull. Full scale experiments with a Japanese cement carrier vessel used precisely these prior art techniques and obtained only a 2-3% drag reduction.

Historically, it has been difficult to convince boat owners to allow their boats to undergo invasive modifications with no guarantee of any gain in efficiency. The bows of the larger carriers, as well as the majority of other types of boats, have V-shaped bows that split the stream of incoming water sideways and away from the hull. In this design, the bubbles released in such streams end up mostly on the side of the vessel, with only a small amount washing underneath the hull. This small amount is typically insufficient to make a difference to the efficiency of the vessel. Even if a large volume of bubbles is released at the bottom of one of these ships in the bow region, these bubbles will quickly wash away and, if not replenished, will only lubricate a fraction of the large and typically long hull. As such, the bubbles only lower the drag a small amount.

For smaller crafts, with shallower drafts and relatively short bodies, obtaining sufficient lubrication should be easier to obtain. However, such sufficient lubrication has not yet been achieved in the Prior Art. For example, U.S. Pat. No. 7,004,094 offers a lubrication solution that, when put into practice, is very cumbersome to implement, difficult to maintain, and inoperable. In short, U.S. Pat. No. 7,004,094 in practice either does not work or does not accomplish a sufficient lubrication for a small vessel.

Thus, what is needed is to provide the equivalent of a bubble layer or an air film in a manner that does not require active power input, or at least, very low power, and which has a strong chance of being retained at the surface of the submerged hull where it is needed to effectively reduce the drag of the vessel as it moves through the water.

Furthermore, because air bubbles have a tendency to migrate and dissipate as they lubricate the bottom of the vessel, the air bubbles need to be constantly replenished in order to maintain optimal drag reduction. The migration and dissipation of the air bubbles is especially quick at the deeper submerged parts of the vessel. In order to accomplish this constant replacement of air bubbles, vast amounts of compressed air are needed to overcome the static water pressure at these depths. Unfortunately, rather than becoming more efficient when higher volumes of air are needed, the standard air compressors generally become less efficient when higher volumes of air are needed. At best, the fuel used by a standard air compressor would be equal to the amount of fuel saved by the drag reduction. As such, standard powered air compressors are not an efficient enough solution to constantly replenish the air bubbles deep at the bottom of a vessel.

As discussed above, there are many references teaching how bubbles released once at the bow of a vessel with lubricate the hull of the vessel and reduce drag. Unfortunately, these references: (1) do not take into consideration the migration and dissipation of the bubbles that are merely released at the bow of the vessel; (2) make incorrect assumptions; and/or (3) simply would not work.

Further, when a vessel is sailing, it may frequently drift sideways due to winds or currents. Therefore, it is important to have a way to replenish the air bubbles directly to the sides of the vessel hull, where they are most useful. Before the present invention, no apparatus or method existed that provided a network of removable pipes to distribute air bubbles to any given location on the bottom of a hull.

Therefore, what is needed is a method and apparatus that generates large amounts of compressed air as air bubbles in a consistent manner to the bottom and sides of a vessel hull.

The most viable solution to the problem of efficiently providing the mass quantities of bubbles to the bottom of a boat hull is disclosed by U.S. Pat. Nos. 7,997,221, and 8,327,784, which are incorporated by reference herein as though set forth in their entirety, issued to Dan Nicolaus Costas, one of the named inventors of the present invention.

The present invention offers solutions to these problems adapted to be used for either small vessels with a predictable shallow draft and relatively short hulls or large displacement vessels, with variable drafts and long hulls.

SUMMARY OF THE INVENTION

To minimize the limitations in the prior art, and to minimize other limitations that will become apparent upon reading and understanding the present specification, the present invention discloses a method and apparatus of reducing drag for a nautical vessel by interposing air bubbles between the exterior of the hull of a nautical vessel and the body of water through which the vessel is moving.

One embodiment of the present invention is an apparatus for generating compressed air on a nautical vessel, comprising: at least one water intake opening; at least one ascending pipe; at least one air injector; at least one descending pipe; at least one air collection chamber; and at least one compressed air storage tank; wherein a stream of water generated by a motion of the nautical vessel enters the air injector through the at least one water intake opening and at least one ascending pipe, such that the stream of water creates a depression that pulls a plurality of air into the stream of water; wherein a plurality of air bubbles are formed in the stream of water by the plurality of air entering the stream of water; wherein the plurality of air bubbles are carried in the stream of water down the at least one descending pipe to the at least one chamber; wherein the stream of water and the plurality of air bubbles separate in the at least one air collection chamber, forming at least one separated air portion and at least one separated water portion; wherein the one separated air portion is compressed by a pressure of the at least one separated water portion; and wherein the at least one separated air portion passes into the at least one compressed air storage tank to form a compressed air. Preferably, the at least one pressure device is comprised of at least one pressure valve; wherein the at least one separated water portion exits the at least one air collection chamber through the at least one pressure device; and wherein the pressure of the at least one water portion is determined by the at least one pressure device. Preferably, the at least one pressure device is at least one pressure valve; wherein the water portion exits the at least one chamber through the at least one pressure valve; wherein the pressure is determined by the pressure of the at least one pressure valve and a depth of the at least one descending pipe; and wherein the pressure is less than a static pressure at a level plus a dynamic pressure of the stream of water arriving in the at least one air collection chamber. The at least one ascending pipe and the at least descending pipes may have at least one flexible portion, such that a height of the at least one air injector is adjustable. The at least one water intake opening may be a funnel. The apparatus for generating compressed air on a nautical vessel may further comprise: a plurality of pipes; wherein the plurality of pipes may be connected to the at least one compressed air storage tank; wherein the plurality of pipes may have a plurality of valves, such that the plurality of valves are between the at least one compressed air tank and a plurality of openings of the plurality of pipes; wherein one or more of the plurality of valves are opened, such that the compressed air passes through the plurality of open valves and exits the plurality of open valves; wherein the compressed air exits as a plurality of exiting air bubbles; and wherein the plurality of exiting air bubbles reduces a friction between the nautical vessel and a body of water. The apparatus for generating compressed air may be mounted within an interior of the hull of the nautical vessel. The apparatus for generating compressed air may be mounted on an exterior of the hull of the nautical vessel. The air intake of the at least one air injector may be aided by additional air pressure of at least one air fan.

It is an object of the present invention to provide a means to generate the necessary volumes of compressed air without using the additional fuel needed by compressors. Rather, the necessary energy to compress air is preferably taken from the dynamic pressure exercised on the hull by the water while sailing.

It is an object of the present invention to overcome the limitations of the prior art.

These, as well as other components, steps, features, objects, benefits, and advantages, will now become clear from a review of the following detailed description of illustrative embodiments, the accompanying drawings, and the claims.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps which are illustrated. When the same numeral appears in different drawings, it refers to the same or like components or steps.

DETAILED DESCRIPTION OF THE DRAWINGS

Figure 1:
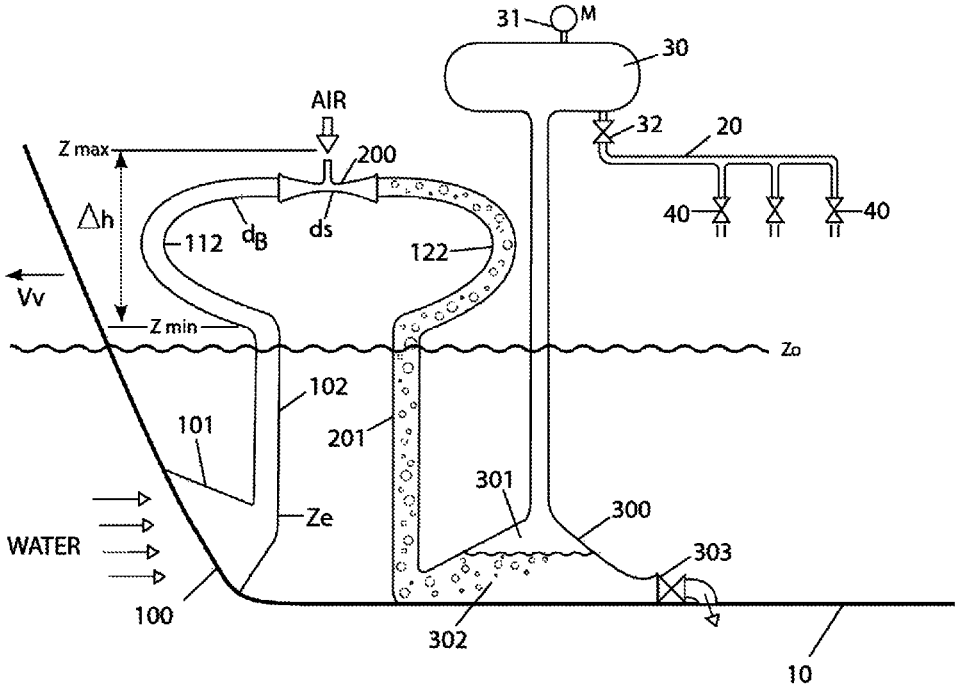
FIG. 1 is a side view of one embodiment of the apparatus for lowering drag on a moving nautical vessel.

In the following detailed description of various embodiments of the invention, numerous specific details are set forth in order to provide a thorough understanding of various aspects of one or more embodiments of the invention. However, one or more embodiments of the invention may be practiced without some or all of these specific details. In other instances, well-known methods, procedures, and/or components have not been described in detail so as not to unnecessarily obscure aspects of embodiments of the invention.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the graphs, figures, and the detailed descriptions thereof, are to be regarded as illustrative in nature and not restrictive. Also, the reference or non-reference to a particular embodiment of the invention shall not be interpreted to limit the scope of the invention.

In the following description, certain terminology is used to describe certain features of one or more embodiments of the invention. For instance, the terms "Venturi effect" and "Venturi pipe" refer to the reduction in fluid pressure that results when a fluid flows through a constricted section of tube, channel, or pipe; wherein the constricted area causes a decrease in pressure and results with higher pressure air into the lower pressure water. The term "nautical vessel" refers to any vehicle or craft, of any size, made out of any type of materials, which preferably travels in or on any body of water, including, but not limited to rivers, streams, lakes, ponds, oceans, or seas. The term "air fan" refers to any low power motor apparatus that moves air, including without limitation, blowers, fans, or centrifugal fans. The term "air injector" refers to device that causes a Venturi effect depression in the water, such that adjacent air is sucked into the water in the form of bubbles. The term "air injector" refers to any device that generates a depression where air is being drawn and generates a mixture of water with air bubbles. An air injector may also be a Venturi pipe (or tube) that; (1) causes water to enter through a wide opening; (2) squeeze into a narrow portion where a depression is created; (3) draw in air from a provided air intake; and (4) mix water with air bubbles, as the water and air bubbles exit the enlarged exit. Either design of the air injector may be employed, and preferably be referred to as the Venturi pipe.

The present invention is preferably a method and apparatus that reduces drag of a nautical vessel, as the nautical vessel travels across the water. Generally, the submerged bodies of nautical vessels are subjected to drag due to friction with water. The friction can be greatly reduced if, in the immediate boundary layer, air bubbles are placed in-between the water and the hull, as the efficacy of air bubbles have been demonstrated in both laboratory and full scale tests. Because air bubbles released at the front end or bow of a vessel typically have a tendency to migrate and dissipate, the air bubbles need to be constantly replenished. This is typically achieved (especially in deeper boat hulls) by providing vast amounts of compressed air to overcome the static water pressure. The present invention provides vast amounts of compressed air to replenish the bubbles by utilizing the dynamic pressure of water on the hull of the boat, as the boat moves through the water.

FIG. 1 is a side view of one embodiment of the apparatus for lowering drag on a moving nautical vessel. FIG. 1 shows a configuration that can be adapted to almost any vessel, adjusting the dimensions of the Venturi pipe as well as its elevation to match the dynamic pressure available at various speeds. Generally, the system can easily be implemented on existing vessels externally, during routine servicing or repairs, or shielded by a protective covering from the elements without any invasive procedures. The system may also be implemented inside the hull on newly built vessels.

If the dimensions of pipes are inconveniently large for certain vessels, smaller diameter pipes can typically run in parallel, accomplishing the same result. Also, more than one system may be attached to the same vessel, as needed. Sometimes, one system is not feasible because of the impractical diameters of the pipes and, as a result, more systems of smaller sizes can typically be employed to deliver the necessary amount of compressed air.

Recently, Mitsubishi Heavy Industries (MHI). the biggest ship builder in Japan, introduced its Mitsubishi Air Lubricating System (MALS), which lowered the fuel consumption by a net 7%. Despite the shortcomings of their system, the orders for new ships employing this MALS jumped to the point that the company ran out of building capacity having to farm out to other shipbuilders the technology. However, the MALS has three big disadvantages: First it uses powerful turbofans to provide the air for the air bubbles carpet. These turbofans besides being expensive, consume significant amounts of fuel themselves which gets deducted from the fuel saving due to lubrication, hence just 7% fuel reduction instead of 15-20%. Second, as powerful as these fans are, they cannot push the air deeper than 5 meters therefore the drafts of the prospective vessels cannot go beyond 5 meters. This dramatically reduces the usefulness of the system. Most of bulk carriers, tankers, and LPGs have higher drafts. Third, the MALS can be installed only on newly built vessels while existing fleets are left out or would need major overhauls that MHI does not offer.

Nevertheless, their technology proved beyond doubt the efficiency of air lubrication at full scale vessels.

Clearly, the challenge is to provide the vast amounts of air necessary to be distributed along the hull at a pressure just slightly higher than the static pressure of water at the bottom of the hull.

The object of this application is to preferably provide means to generate the necessary volumes of compressed air without using the additional fuel needed by compressors. Instead, the necessary energy to compress air is preferably taken from the dynamic pressure exercised on the hull by the water while sailing.

The dynamic pressure of water exercised on the frontal silhouette of the boat is generally proportional with the speed of the boat squared divided by 2. For instance, if the speed is 10M/sec, (the equivalent of 20 knots, 10 squared=100, divided by 2=50), the dynamic pressure should be 5M of water column=0.5 At.

The purpose and aim of this invention is preferably to deliver air to the bottom of a boat in order to lubricate its passage through water, thereby reducing its drag and fuel consumption. This is preferably done by utilizing energy that the boat transfers to the water in front of it, as the boat travels through said water with speed $v_v$, as seen in FIG. 1. $Z_0$ typically represents sea level and will be our zero reference level with regards to all measures of height. $Z_E$ is preferably the depth at which the entrance 100 to our system is positioned; $Z_{min}$ is preferably the lowest level; and $Z_{max}$ is preferably the highest level above $Z_0$ that our system will draw air through Venturi 200.

The entrance to the system 100 typically comprises of a funnel (or water intake opening) 101 which accepts a flow of water $F_E$ into a pipe 102, which then continues to Venturi 200. Preferably, $d_E$ is the outer diameter of the funnel 101 of flow $$F_E = \frac{d_E}{4}\pi v_v,$$

assuming that the vessel is traveling in a forwards direction. Further, friction is typically assumed to be negligible in the pipeline.

The venturi tube 200 is preferably adjustable in height, such that the venturi tube 200 can always be in a position in which it will accept a flow of air $F_{VA}$ into its flow of water $F_{VW}$, and thus, delivers a flow of air-water colloid or mixture $F_{VAW}$ to air collection chamber 300. If the diameter $d_{201}$ of the (descending) pipe 201 is so large such that air is not delivered to air collection chamber 300, then $d_{201}$ should be reduced. The diameters $d_B$ and $d_S$ correspond to the (ascending) pipe 102 before the Venturi 200, and to the Venturi 200 itself, respectively. These diameters contribute to the determination of $Z_{max}$, $Z_{min}$, and $\Delta h = Z_{max} - Z_{min}$.

FIG. 1 shows that the ascending and descending pipes 102 and 202 preferably have flexible portion 112 and 122.

Consider the Bernoulli equation $$H = z + \frac{p}{\rho g} + \frac{v^2}{2g}$$

where H is the head of water z the elevation over a reference level, p the water pressure, ρ the density of water, g the acceleration of earth's gravitational field, and v the speed of the water. This head is typically constant throughout a pipeline of water. Therefore, $$H = Z_E + \frac{p_E}{\rho g} + \frac{v_v^2}{2g} = Z_{min} + \frac{p_s}{\rho g} + \frac{v_s^2}{2g} = Z_{max} + \frac{p_B}{\rho g} + \frac{v_b^2}{2g}$$

with $p_E$ being the water pressure at depth $Z_E$, $v_S$, $p_s$, $v_b$, and $p_B$ being the water speeds and pressures in Venturi 200 and pipe 102, respectively. It is also known, that similarly to Kirchhoff's law for electrical circuits, the flow through any point in a pipe is the same as through all other parts of the pipe if no water escapes. As such $$F_E = F_{VW} = \pi\frac{d_E}{4}v_v = \pi\frac{d_S}{4}v_s = \pi\frac{d_B}{4}v_b.$$

To draw air into the Venturi, $p_s$ is generally lower than 1 atm, such that the apparatus does not completely flood with air and halt the flow of water $p_B$, which must be greater than 1 atm. As such these are preferably the boundaries with which we shall determine $Z_{max}$ and $Z_{min}$. Pressure under a body of water typically increases approximately by 1 atm for every 10 meters depth. Therefore $$p_E = \frac{Z_E}{-10\text{ m}} \times 1\text{ atm}.$$

Then, it follows that $$H = Z_E - \frac{\frac{Z_E}{10\text{ m}} \times 1\text{ atm} + 1\text{ atm}}{\rho g} + \frac{v_v^2}{2g}.$$

Furthermore, since for $Z_{min}$ the pressure $p_s$ is set to 1 atm, it follows from above that $$Z_{min} = Z_E - \frac{\frac{Z_E}{10\text{ m}} \times 1\text{ atm} + 1\text{ atm} - 1\text{ atm}}{\rho g} + \frac{v_v^2 - v_s^2}{2g} = Z_E - Z_E + \frac{v_v^2 - v_s^2}{2g} = \frac{v_v^2}{2g}\left(1 - \frac{d_E^4}{d_S^4}\right)$$

since also from above $$v_s = \frac{d_E^2}{d_S^2}v_v.$$

Similarly $$Z_{max} = \frac{v_v^2}{2g}\left(1 - \frac{d_E^4}{d_B^4}\right)$$

and therefore $$\Delta h = \frac{v_v^2}{2g}d_E^4\left(\frac{1}{d_S^4} - \frac{1}{d_B^4}\right).$$

It should be noted that Δh, that is, the range of viable venturi positions, grows larger with increasing boat speed, but can also be made large for slow vessels by using appropriately proportioned Venturi tubes and entrance funnels, as these also determine the range.

Upon exiting venturi 200, the water-air colloid flow $F_{VAW}$ then proceeds to the air collection chamber 300 through input pipe 201. The air collector chamber 300 separates the colloid flow $F_{VAW}$ into compressed air 301 and water 302, which both have a pressure equal to that of the water environment underneath the boat. Due to this high pressure, water 302 flows out the exit 303 (which can be modulated with a pressure valve or ascending pipeline to increase the pressure of the exiting water) and therefore may raise the air pressure even more. Compressed air 301 typically flows to tank 30 and generally resides there. One can also completely bypass air collection chamber 300 and tank 30 by letting the water-air colloid flow onto the underside of the boat, but this does not typically supply compressed air to be used efficiently but rather just releases it as it comes. Air tank 30 generally contains the compressed air and can be outfitted with a manometer 31, and a valve 32, such that releases air is to be distributed underneath the boat as needed by manual or computer assisted control systems. Furthermore, the compressed air can also be used for other purposes. If need be, the air intake of the air injector (Venturi) may be aided by an air fan adding to the atmospheric pressure.

Figure 2:
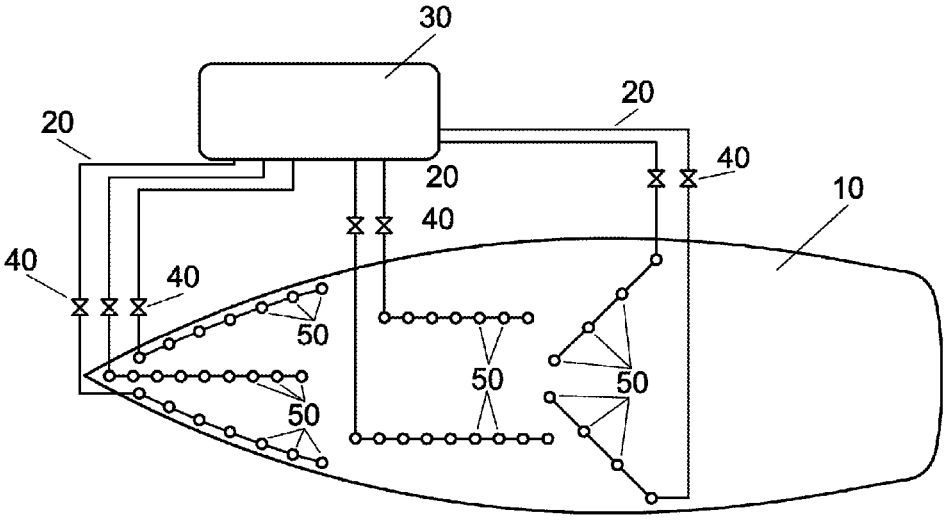
FIG. 2 is a bottom view of one embodiment of the present invention and shows a system of pipes for delivering bubbles to the hull of a vessel.

FIG. 2 is a bottom view of one embodiment of the present invention and shows a system of pipes for delivering bubbles to the hull of a vessel. FIG. 2 shows that the compressed air has already been captured in compressed air storage tank 30, which may be located anywhere on the nautical vessel 10. The compressed air storage 30 may be preferably a separate compressed air tank, or it may consist of the higher part of the separation chamber 300 if this is big enough to accommodate enough compressed air. Once the compressed air is captured, the air may be replenished to any part of the vessel or it may be distributed to barges that follow the main vessel or latter parts of a very long vessel. FIG. 2 also shows that the compressed air is preferably distributed to the bottom of vessel 10 though pipes 20. The valves 40 are opened and closed on command, allowing the compressed air to be released through holes 50. Using the system of pipes 20, shown in FIG. 2, the compressed air may be selectively and controllably delivered to the bottom of the vessel 10. The valves 40 may be manually controlled or controlled via a computer or other automated system.

Unless otherwise stated, all measurements, values, ratings, positions, magnitudes, sizes, locations, and other specifications which are set forth in this specification, including in the claims which follow, are approximate, not exact. They are intended to have a reasonable range which is consistent with the functions to which they relate and with what is customary in the art to which they pertain.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention. It is intended that the scope of the invention not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

What is claimed is:

1. An apparatus for generating compressed air on a nautical vessel, comprising:

at least one water intake opening;

at least one ascending pipe;

at least one air injector;

at least one descending pipe;

at least one air collection chamber; and at least one compressed air storage tank;

wherein a stream of water generated by a motion of said nautical vessel enters said air injector through said at least one water intake opening and at least one ascending pipe, such that said stream of water creates a depression that pulls air into said stream of water;

wherein air bubbles are formed in said stream of water by said air entering said stream of water;

wherein said air bubbles are carried in said stream of water down said at least one descending pipe to said at least one chamber;

wherein said stream of water and said air bubbles separate in said at least one air collection chamber, forming at least one separated air portion and at least one separated water portion;

wherein said one separated air portion is compressed by a pressure of said at least one separated water portion; and wherein said at least one separated air portion passes into said at least one compressed air storage tank to form a compressed air.

2. The apparatus for generating compressed air on a nautical vessel of claim 1, wherein a pressure device is comprised of at least one pressure valve;

wherein said at least one separated water portion exits said at least one air collection chamber through said pressure device; and wherein said pressure of said at least one water portion is determined by said pressure device.

3. The apparatus for generating compressed air on a nautical vessel of claim 2, wherein said water portion exits said at least one air collection chamber through said at least one pressure valve;

wherein said pressure is determined by said pressure of said at least one pressure valve and a depth of said at least one air collection chamber; and wherein said pressure is higher than the static pressure at the bottom portion of the ship due to the added dynamic pressure of said stream of water arriving in said at least one air collection chamber.

4. The apparatus for generating compressed air on a nautical vessel of claim 3, further comprising at least one descending pipes;

wherein said at least one ascending pipe and said at least one descending pipe have at least one flexible portion, such that a height of said at least one air injector is adjustable.

5. The apparatus for generating compressed air on a nautical vessel of claim 3, wherein said at least one water intake opening is a funnel.

6. The apparatus for generating compressed air on a nautical vessel of claim 3, further comprising:

a plurality of pipes;

wherein said plurality of pipes are connected to said at least one compressed air storage tank;

wherein said plurality of pipes have a plurality of valves, such that said plurality of valves are between said at least one compressed air tank and a plurality of openings of said plurality of pipes;

wherein one or more of said plurality of valves are opened, such that said compressed air passes through said plurality of open valves and exits said plurality of openings of said plurality of pipes;

wherein said compressed air exits as a plurality of exiting air bubbles; and wherein said plurality of exiting air bubbles reduces a friction between said nautical vessel and a body of water.

7. The apparatus for generating compressed air on a nautical vessel of claim 6, wherein said apparatus for generating compressed air is mounted within an interior of said hull of said nautical vessel.

8. The apparatus for generating compressed air on a nautical vessel of claim 6, wherein said air intake of said at least one air injector is aided by additional air pressure of at least one air fan.

* * * * *